United States Patent [19]

Easter et al.

[11] Patent Number: 4,898,051

[45] Date of Patent: Feb. 6, 1990

[54] CONNECTOR MATE/DEMATE TOOL

[75] Inventors: David A. Easter, Westerville; William R. Dick, Columbus; Donald J. Hackman, Columbus; Kathryn E. Alexander, Columbus, all of Ohio

[73] Assignee: Battelle Memorial Institute, Columbus, Ohio

[21] Appl. No.: 289,055

[22] Filed: Dec. 23, 1988

[51] Int. Cl.[4] ..... B25B 17/00

[52] U.S. Cl. ..... 81/57.2; 81/57.16; 81/57.34

[58] Field of Search ..... 87/57.15, 57.16, 57.2, 87/57.73, 57.34, 57.36

[56] References Cited

U.S. PATENT DOCUMENTS 4,494,425 1/1985 Shewmake ..... 81/57.2 X 4,497,224 2/1985 Jurgens ..... 81/57.16 X 4,674,366 6/1987 Lauer et al. ..... 81/57.16 X

*Primary Examiner*—James G. Smith

*Attorney, Agent, or Firm*—Philip J. Pollick; Robert B. Watkins; Philip M. Dunson

[57] ABSTRACT

A connector mate/demate tool provides remote coupling and decoupling of connector sections with a rotating locking ring on one section of the connector and where the other section is rigidly attached to some fixture. The tool mates the connector sections by first searching for a key-slot engagement of parts while exerting a small longitudinal force and then rotating the locking ring until the two sections are secured. Demating is accomplished by rotating the locking ring in the reverse direction and pulling the two connector sections apart.

33 Claims, 3 Drawing Sheets

FIG. 1
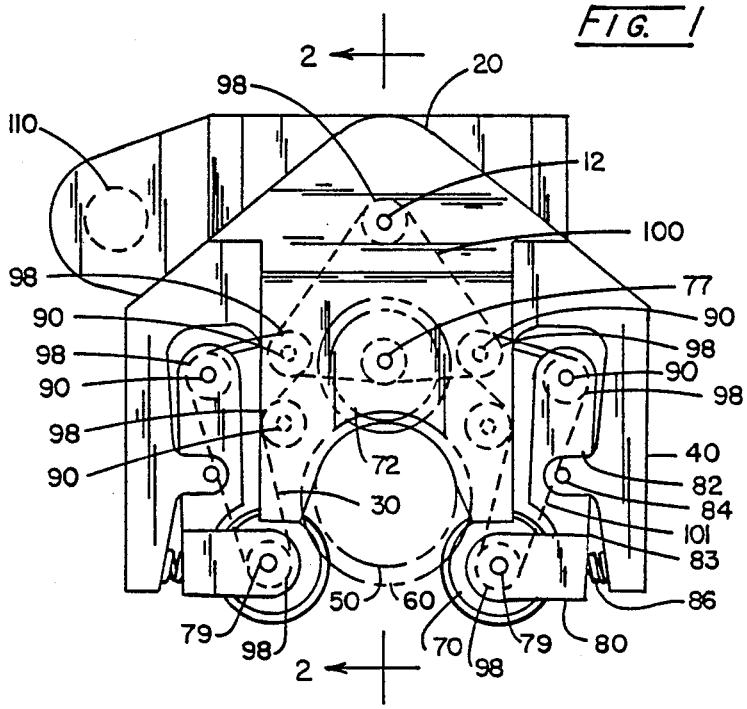
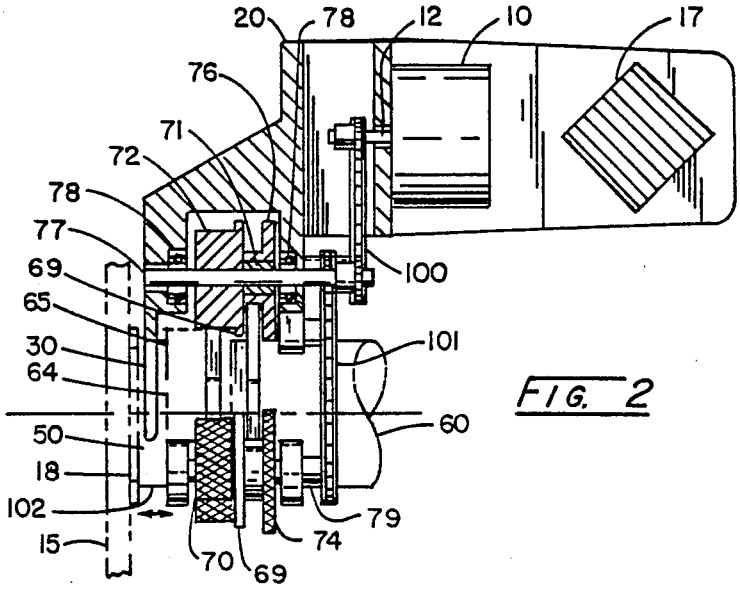
FIG. 2

CONNECTOR MATE/DEMATE TOOL

FIELD OF THE INVENTION

The present invention relates to a tool for remote coupling and uncoupling of cable connectors. More specifically, it relates to a tool for axially aligning the male and female sections of a connector, aligning the pins and sockets in the male and female sections of the connector, and securing or unsecuring the male and female sections of the connector.

BACKGROUND OF THE INVENTION

The exploration of remote environments, such as space exploration, places a premium on the optimization of the use of a minimum amount of equipment taken into such areas. In remote areas, the availability of energy sources, especially multiple power sources, is limited. As such, a limited number of such sources must serve a multiple number of needs. One way to distribute power from a limited number of sources to a multiple number of applications is through the use of connection devices that enable the connection of a single output source to a multiple number of applications. However, in remote applications, the securing and unsecuring (mate/demate) of power or energy connectors is subject to a number of constraints. First, the connector sections must be properly aligned so as to mate with each other. Second, the individual conductors within the connector sections must also be properly aligned with each other. Third, the connector sections must be securely fastened to each other to prevent accidental disconnection through vibration, accidental dislocation by unsecured objects, and other disruptive forces. Although connectors can be readily secured and unsecured in a manned environment, the problem of effectively mating and demating electrical connectors in a remote environment is quite complex.

Although the problems involved in connector manipulation have been addressed in several contexts, none have direct bearing on the securing and unsecuring of connectors in remote environments. For example, in U.S. Pat. No. 4,581,956 to Robert, a stud bolt screwing-/unscrewing apparatus is described for securing the lid of a reactor vessel in a nuclear reactor. U.S. Pat. No. 4,523,884 to Clement et al. reveals a remote telescopic manipulation assembly that is retractable into a tightly sealed hood. U.S. Pat. No. 4,420,199 to Vis et al. discloses rotary joint cable connectors for use with welding cables on robots. U.S. Pat. No. 4,246,809 to Keast et al. shows a power tong apparatus for making and breaking threaded connections between length of small diameter pipe. U.S. Pat. No. 4,218,172 to Freund relates to a method of and an arrangement for controlling manipulators or industrial robots. The above patents appear to be only of general applicability to the present invention. None of the patents accomplish the purposes of the present invention.

SUMMARY OF THE INVENTION

The present invention is a tool for connecting or disconnecting connector sections, that is, mating or demating connectors. The tool consists of a means for axially aligning a male and a female section of a connector and then securing or unsecuring the male and female sections to or from each other. The axial alignment of the male and female connector sections is accomplished by appropriate means associated with the housing (support frame) of the tool. The male and female sections of the connector are secured (locked) to or unsecured (unlocked) from each other by means of a rotational drive such as a motor that is attached to the support frame. In electrical, hydraulic, optical, communications and similar applications, the mate/demate tool may additionally have a means for aligning conductor pins and corresponding conductor sockets in the respective male and female connector sections.

Axial alignment of the male and female sections of a connector can be accomplished by means of a U-shaped foot with a circular recess or opening that conforms to the external radial surface of a connector section that is rigidly and permanently secured to some fixture. Another portion of the tool, that is alignment arms, holds the other section of the connector in axial alignment with the circular opening or recess of the U-shaped foot. When the U-shaped recess of the foot is brought in contact with the radial outer surface of the secured connector section, the other connector section is held by the alignment arms in axial alignment with the secured section. Although it is to be understood that either the male or female section of the connector can be secured to a rigid structure such as a bulk head or wall, for the purposes of this discussion, the female connector section will be taken as the secured, immovable section of the connector.

To secure or lock the male connector to the bulkhead-secured female connector, a threaded lock ring on the male connector is screwed onto mating threads on the female connector. The rotation of the threaded lock ring is accomplished by holding the male section of the connector in a set of friction rollers that are in contact with the lock ring. The friction rollers are driven by the rotational drive means, that is, a motor. The motor and frictional rollers are linked by appropriate means such as gears, belts, or preferably a chain and sprocket assembly. The friction rollers are attached to the tool alignment arms of the frame by means of a rocker arm/-spring assembly which allows a positive gripping force to be applied by the rollers to the male connector section while at the same time allowing the mate/demate tool to engage or disengage the male section of the connector when it is secured or locked to the female section of the connector.

Conductor pins and sockets in the male and female sections of the connector can be aligned by suitable means. For example, by providing a key in the female connector section and a mating slot in the male connector section, the conductor pins and sockets can be brought into correct alignment with each other. Correct alignment is achieved by a second set of connector friction rollers that rotate the male connector until the key and slot align and engage each other thereby causing the conductor pins and sockets to correctly mate. Preferably the male connector section is rotated in a forward direction for 180 degrees or in a reverse direction for 180 degrees in order to align the key and slot. By allowing only 180 degree forward or reverse rotation, undue strain on the corresponding cable is avoided. A flange may be placed on either the connector friction rollers or the lock ring friction rollers so as to contact the male connector in such a fashion so that a force may be applied to the male connector so as to cause the key and slot, the conductor pins and sockets, and the male and female connector sections to engage each other.

In a preferred embodiment, the lock ring frictional drive rollers and the connector friction drive rollers are mounted on the same rotatable shaft. By providing the connector friction rollers with a slip clutch, the connector friction rollers stop rotation when the key and slot of the two connector sections engage each other, while the lock-ring frictional drive rollers continue to rotate the lock ring causing the lock ring to be threaded onto the threads of the female connector.

The tool is further provided with a grip for grasp by fingers of a robotic manipulator arm. The robotic arm and mate/demate tool are further provided with an electrical connection means so as to connect the robotic manipulator arm to a rotational drive means such as a motor.

Other objects and features of the invention will be apparent and understood from the detailed description of the invention and the accompanying drawings which follow. The foregoing and other advantages of the invention will become apparent from the following disclosure from which the preferred embodiment of the invention is described in detail and illustrated in the accompanying drawings. It is contemplated that variations in procedures, structural features and arrangement of parts may appear to the person skilled in the art without departing from the scope or sacrificing any of the advantages of the invention.

BRIEF DESCRIPTION OF THE DRAWINGS

FIG. 1 is a front elevational view of the mate/demate tool.

FIG. 2 is a side cross-sectional view taken substantially as indicated by line 2—2 in FIG. 1.

Figure 3:
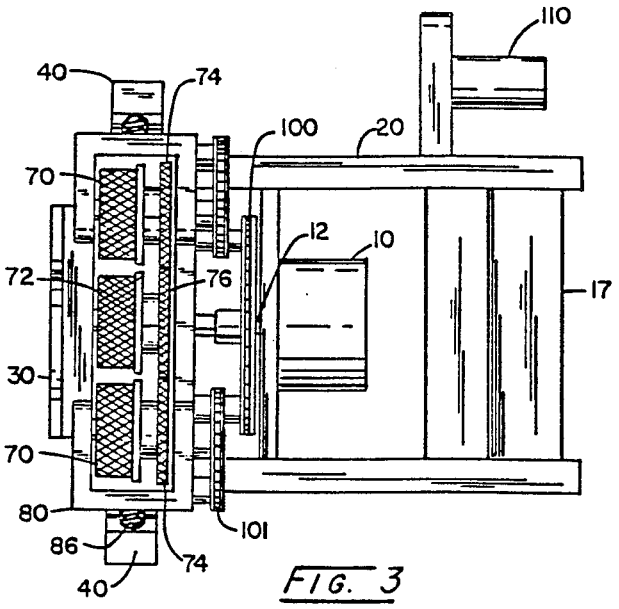
FIG. 3 is a bottom view of the mate/demate tool.

It may be possible that shapes other than those of FIGS. 1-6 could be used, but that which is shown is preferred and typical. In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. It is noted that the "female" and "male" sections are readily interchanged and, as such, are more generally referred to as first and second sections.

Although a preferred embodiment of the invention has been herein described, it will be understood that various changes and modifications in the illustrated and described structure can be effected without departure from the basic principles that underlay the invention. Changes and modifications of this type are therefore deemed to be circumscribed by the spirit and scope of the invention, except as the same may be necessarily modified by the intended claims or reasonable equivalents thereof.

DETAILED DESCRIPTION OF THE INVENTION AND THE BEST MODE FOR CARRYING OUT THE PREFERRED EMBODIMENT

Figure 4:
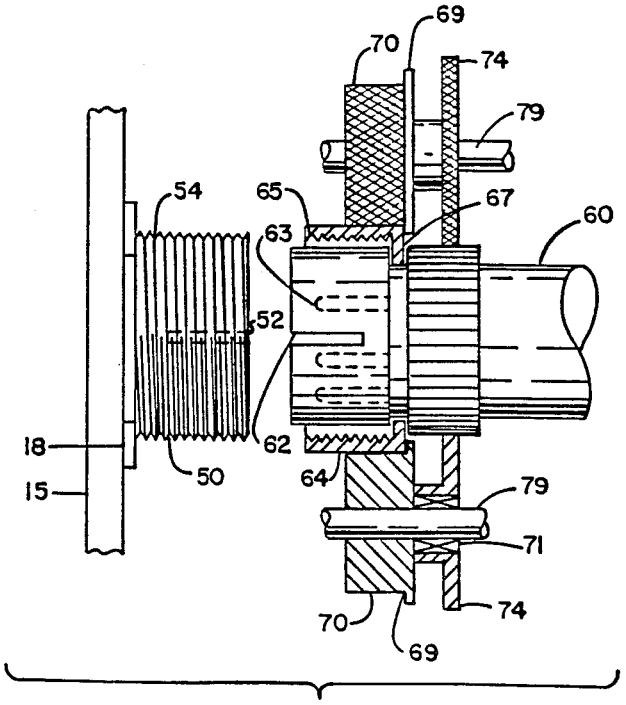
FIG. 4 is a partial cross-sectional view of the female and male connector sections and frictional rollers.
Figure 5:
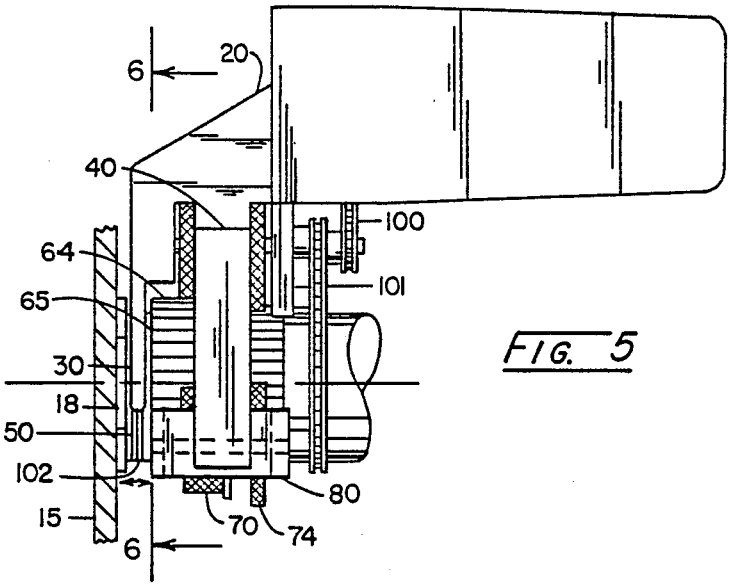
FIG. 5 is a side view illustrating the alignment foot for the female connector and the alignment arm for the male connector.
Figure 6:
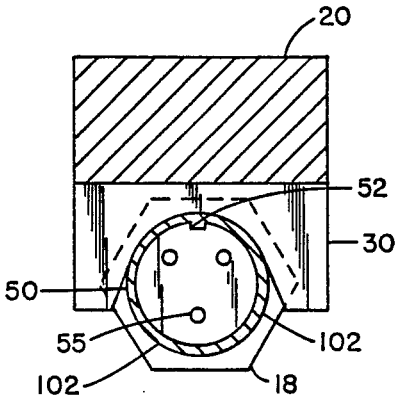
FIG. 6 is a cross-sectional view taken substantially as indicated by line 6—6 in FIG. 5 and showing the alignment foot in contact with the female connector section.

As shown in FIGS. 1 and 2, this invention is a tool that has a rotational drive means 10, such as a motor, operable preferably in both a forward and reverse direction, a support frame/housing 20, a means for axially aligning the female section 50 with the male section 60 of a connector such as U-shaped foot 30 (FIG. 5) and alignment arms 40 with associated friction rollers 70, 72, 74 and 76; and a means for securing and unsecuring the male section 60 of the connector such as friction rollers 70, 72, 74 and 76. As shown in FIGS. 4 and 6, one means for aligning the conductor pins 63 in the male connector 60 with the corresponding conductor sockets 55 in said female section 50 consists of a key 52 located on the interior of the exterior wall of the female connector and a slot 62 in the male connector exterior wall. As illustrated in FIGS. 2, 4 and 6, the female section 50 is secured to the bulkhead wall 15 by suitable means such as a nut 18. The tool may also be provided with a grip 17 for grasp by a robotic manipulator arm (not shown) and means for electrical connection 110 of the drive means 10 to a power source.

As shown in FIGS. 1 and 6, female-connector alignment foot 30 is U-shaped with a circular interior recess or opening of a radial cross-section that conforms to the radial curvature of the exterior wall 102 of female section connector 50. As shown in FIGS. 2 and 5 by the arrow, the alignment foot 30 is capable of moving longitudinally along the exterior radial surface 102 of the female connector section 50. By moving U-shaped foot 30 longitudinally along the radial outer wall 102 of the female connector 50 and away from the bulk-head wall 15, the foot 30 is brought in contact with bottom edge 65 of lock ring 64. If the lock ring 64 has been unthreaded from the threads 54 of the female connector 50, a longitudinal force exerted against the bottom edge 65 of lock ring 64 serves to disengage the conductor pins 63 (FIG. 4) from their respective sockets 55 (FIG. 6) and disconnect the male connector section 60 from the female connector section 50. The male connector 60 is maintained in axial alignment with the circular recess of the opening of alignment foot 30 by means of friction rollers 70, 72, 74, and 76.

As shown in FIGS. 1 and 5, alignment arms 40 are a part of or securely attached to housing 20. As shown in FIG. 2 frictional rollers 72 and 76 are axially mounted on rotatable shaft 77 which is affixed to housing 20 and rotates freely therein by means of ball bearings 78. As evident in FIG. 1 friction rollers 70 and 74 are attached to rotatable shaft 79 which is rotatably attached to a U-shaped bracket 80 rigidly secured to the outer end 83 of rocker arm 82. Rocker arm 82 is pivotly attached to the interior side of alignment arm 40 by means of pivot pin 84. A spring 86 between U-shaped bracket 80 and alignment arm 40 secures male connector section 60 among friction rollers 70, 72, 74 and 76 while also allowing the tool to be withdrawn from the male connector section 60 once it has been secured to the female connection section 50.

The friction rollers 70, 72, 74 and 76 are driven by drive shaft 12 of motor 10 through appropriate drive means such as gears, pulleys, belts or preferably a chain and sprocket assembly comprising chains 100 and 101 and sprockets 98. The chains 100 and 101 are appropriately routed by means of the rotatable shafts 77 and 79 of the friction rollers, the drive shaft 12 of motor 10, the rotatable chain routing shafts 90, and sprockets 98. As shown in FIGS. 2 and 4, friction rollers 74 and 76 are provided with a slip clutch 71. Friction rollers 74 and 76 rotate the male section 60 of the connector so as to bring slot 62 in alignment with key 52. Slight pressure exerted by the tool through flange 69 of friction roller 70 against the top edge 67 of lock ring 64 causes slot 62 to engage key 52. Preferably the rotation of the male connector 60 is limited to a forward rotation of 180° and a reverse rotation of 180° to avoid undue stress on the connector cable. At the moment of engagement, slip clutch 71 allows friction rollers 74 and 76 to stop rotating. Continued downward pressure exerted by the tool through flange 69 of friction rollers 70 and 72 causes lock ring 64 to engage the threads 54 of female connector 50 and continued rotation of friction roller 70 and 72 causes lock ring 64 to be threaded onto the threads 54 of female connector 50.

OPERATION OF THE INVENTION

In a demate or disconnect operation, the tool is aligned with the female connector 50 by means of alignment foot 30 while concurrently frictional rollers 70 and 74 move apart by compression of spring 86 so as to allow friction roller 70 and 74 to accept male connector 60 and bring it in contact with friction rollers 72 and 76. Reverse rotation is applied by drive shaft 12 to the chain 100 and sprocket 98 assembly which in turn causes rotatable shafts 77 and 79 to rotate. Since the male and female connector sections are firmly locked together by means of lock ring 64 and slot 62 and key 52, slip clutch 71 allows friction rollers 74 and 76 to remain stationary while friction rollers 70 and 72 rotate causing lock ring 64 to be unscrewed from the threads 54 of the female connector section 50. Once the slip ring 64 has been completely unthreaded from the threads 54 of the female connector section 50, a longitudinal force is exerted by the U-shaped alignment foot 30 against the bottom edge 65 of lock ring 64 causing the male connector 60 to disconnect from the female connector section 50. The force exerted by spring 86 causes the male section 60 to be maintained securely in contact with friction roller 70, 72, 74 and 76 for transport to another female connector section (not shown).

In a mate or connect operation, the male connector section 60 is then brought in alignment with a second female connector section (not shown but identical to the first female connector) by means of alignment foot 30 which contacts the outer surface 102 of female connector section 50. On contact, a longitudinal force is exerted by the tool through flange 69 against the upper surface 67 of lock ring 64. The male connector section is rotated by friction rollers 74 and 76 until slot 62 engages key 52. On engagement, slip clutch 71 allows friction roller 74 and 76 to stop turning. Further longitudinal pressure exerted by the tool through flange 69 against slip ring surface 67 causes the threads of lock ring 64 to engage the threads 54 of the female connector section 50. Rotation of the friction roller 70 and 72 causes the slip ring to be threaded onto the threads 54 of the female section 50 and thereby causing the female and male sections to be firmly secured. The tool may then be withdrawn from the male section 60 and engage another connected male connector section.

It is herein understood that although the present invention has been specifically disclosed with the preferred embodiments and examples, modifications and variations of the concepts herein disclosed may be resorted to be those skilled in the art. Such modifications and variations are considered to be within the scope of the invention and the appended claims.

It is to be especially noted that the terms "female" and "male" sections are used to denote the invention as illustrated. Contemplated equivalents include, but are not limited to, arrangements (1) where the "male" section is fastened to the bulkhead and (2) where the two sections merely abut each other and are secured by the lock ring. As such, the female and male sections are more generally referred to as first and second sections to denote the equivalency of the various arrangements. Similarly, the conductor pins and sockets may be placed in either section or each section may have combinations of both pins and sockets or the conductors of each section may simply abut each other.

We claim:

1. A connector mate/demate tool for mating and demating a first section and a second section of a connector comprising:

a. a support frame;
b. a rotational drive means attached to said frame;
c. a means, attached to said frame, for aligning said frame with said second connector section; and
d. a rotary engagement means, attached to said frame and rotatably contacting said first connector section, for axially aligning said first connector section with said second connector section and driven by said rotational drive means for securing and unsecuring said first and second sections of said connector.

2. The tool as claimed in claim 1 further comprising a means for aligning one or more conductor pins in said first connector section with one or more corresponding conductor sockets in said second connector section.

3. The tool as claimed in claim 1 wherein said means for aligning said frame with said second connector section is a U-shaped foot extending from said support frame and having a circular interior opening of cross-section conforming radially to an external radial surface of said second connector section.

4. The tool as claimed in claim 3 wherein said rotary engagement means is at least one friction roller and means to secure said roller to said support frame.

5. The tool as claimed in claim 4 wherein said roller securing means is a rotatable shaft.

6. The tool as claimed in claim 4 with said friction roller securing means comprising:

(a) at least two alignment arms extending from said support frame;
(b) a rocker arm pivotally attached to the interior side of each said alignment arm and having a first, outer directed end and a second, inner directed end;
(c) a spring attached between said first end of said rocker arm and the end of said alignment arm; and
(d) a rotatable shaft securing said friction roller to said first end of said rocker arm.

7. A tool as claimed in claim 6 further comprising a third friction roller attached to said support frame opposite said rocker arm friction rollers.

8. A tool as claimed in claim 7 with means for rotating said rollers using said rotational drive means.

9. A tool as claimed in claim 8 wherein said means for rotating said rollers is a chain and sprocket assembly.

10. A tool as claimed in claim 9 with said chain and sprocket assembly further comprising at least one rotating, chain routing shaft attached to said frame.

11. The tool as claimed in claim 3 wherein said U-shaped foot is longitudinally movable along said external radial surface of said second connector section.

12. The tool as claimed in claim 2 with said conductor pin alignment means comprising at least one friction roller contacting an exterior radial surface of said first connector section and rotating said exterior surface so as to cause a slot in an exterior radial wall of said first connector section to align with a longitudinal alignment key projecting from the interior side of the exterior radial wall of said second connector section.

13. The tool as claimed in claim 12 wherein rotation of said first connector section is limited to a forward rotation of one-hundred eighty degrees and a reverse rotation of one-hundred eighty degrees from an initial rest position.

14. The tool as claimed in claim 12 with means to apply a longitudinal force to said first connector section to engage said slot of said section with said key of said second section.

15. The tool as claimed in claim 14 wherein said force applying means is a flange on a friction roller attached to said support frame contacting a lock ring axially and rotatably attached to said first connector section.

16. The tool as claimed in claim 12 with means to rotate said friction roller.

17. The tool as claimed in claim 16 wherein said friction roller rotational means is a chain and sprocket assembly connected to said rotational drive means.

18. The tool as claimed in claim 12 with said friction roller further comprising a slip clutch.

19. The tool as claimed in claim 1 wherein said rotary engagement means is at least one friction roller contacting a threaded lock ring rotatably mounted on said first connector section and rotating said lock ring so as to thread it onto mating threads on said second connector section.

20. The tool as claimed in claim 19 with means to rotate said friction roller.

21. The tool as claimed in claim 20 wherein said friction roller rotational means is a chain and sprocket connected to said rotational drive means.

22. The tool as claimed in claim 2 wherein said securing and unsecuring means and said conductor pin alignment means are coaxially mounted adjacent to each other on a rotatable shaft.

23. The tool as claimed in claim 22 wherein said rotatable shaft is connected to said rotational drive means by means of a chain and sprocket assembly.

24. The tool as claimed in claim 23 wherein said connector securing and unsecuring means and said conductor pin alignment means are friction rollers.

25. The tool as claimed in claim 24 with said conductor pin alignment friction rollers further comprising a slip clutch.

26. The tool as claimed in claim 25 with means for mounting one or more of said rotatable drive-shaft friction roller assemblies to said support frame so as to radially engage, hold, and align said first connector section.

27. The tool as claimed in claim 26 wherein said means for mounting said one or more of said friction roller assemblies is a pivoting rocker arm attached to a frame support arm.

28. The tool as claimed in claim 27 wherein a spring is attached between said pivoting rocker arm and said frame support arm.

29. The tool as claimed in claim 28 wherein said friction roller assemblies contact and hold said first connector section in axial alignment with a circular recess of a U-shaped foot attached to said support frame.

30. The tool as claimed in claim 29 wherein said circular recess of said foot contacts and radially conforms to an external radial surface of said second connector section.

31. The tool as claimed in claim 30 wherein said conductor pins are electrical conductor pins.

32. The tool as claimed in claim 1 further comprising a grip attached to said support frame.

33. The tool as claimed in claim 1 further comprising a means for electrical connection of said drive means.

* * * * *